United States Patent [19]

Busch et al.

[11] 4,417,820

[45] Nov. 29, 1983

[54] TIME-KEEPING DEVICE, ESPECIALLY A QUARTZ-CONTROLLED CLOCK

[75] Inventors: Peter Busch, Fenin, Switzerland; Horst Schaefer, Friedrichsdorf, Fed. Rep. of Germany

[73] Assignee: Braun Aktiengesellschaft, Kronberg, Fed. Rep. of Germany

[21] Appl. No.: 358,934

[22] Filed: Mar. 17, 1982

Related U.S. Application Data

[63] Continuation of Ser. No. 202,385, filed as PCT DE79/00137, Nov. 15, 1979, published as WO80/01113, May 29, 1980, § 102(e) date Jun. 19, 1980, abandoned.

[30] Foreign Application Priority Data

Nov. 20, 1978 [DE] Fed. Rep. of Germany ..... 2850295
Nov. 20, 1978 [DE] Fed. Rep. of Germany ..... 2850325
Nov. 20, 1978 [DE] Fed. Rep. of Germany ..... 2850357

[51] Int. Cl.[3] ..... G04B 17/00; G04B 17/12; G04F 5/00

[52] U.S. Cl. ..... 368/200; 368/184; 368/157; 368/160; 368/189

[58] Field of Search ..... 368/62, 76, 80, 184, 368/200, 201, 202, 189, 187, 251, 255, 250, 71–73, 75, 156–183; 331/116 R, 116 M; 328/13, 14; 318/318, 696, 720–722

[56] References Cited

U.S. PATENT DOCUMENTS

| | | | |
|---|---|---|---|
| 3,478,178 | 11/1969 | Grace | 318/318 |
| 3,597,634 | 8/1971 | Slaig | 368/158 X |
| 3,807,164 | 4/1974 | Zaisky et al. | 368/158 |
| 3,940,919 | 3/1976 | Yasuda et al. | 368/251 |
| 3,967,442 | 7/1976 | Berney | 368/201 |
| 4,007,408 | 2/1977 | Berney | 318/314 |
| 4,007,582 | 2/1977 | Duggan et al. | 331/116 M X |
| 4,036,006 | 7/1977 | Effenberger et al. | 331/116 M X |
| 4,041,362 | 8/1977 | Ichiyangi | 318/318 |
| 4,085,577 | 4/1978 | Natori | 368/201 |
| 4,204,397 | 5/1980 | Asano et al. | 368/155 X |

FOREIGN PATENT DOCUMENTS

| | | | |
|---|---|---|---|
| 2118057 | 10/1972 | Fed. Rep. of Germany . | |
| 2305682 | 8/1974 | Fed. Rep. of Germany . | |
| 2359445 | 2/1978 | France . | |
| 1177208 | 1/1970 | United Kingdom | 318/318 |

OTHER PUBLICATIONS

Electronic Circuit Design Handbook, Tab Books, Blue Ridge Summit, Pa., May 1971, pp. 289–290.

*Primary Examiner*—Bernard Roskoski
*Attorney, Agent, or Firm*—Raymond J. DeVellis

[57] ABSTRACT

Electronic clocks with analog time displays and a vibrating quartz crystal (1) as a time standard, as well as electronic frequency dividers (6, 7). The display elements are driven by an electronically controlled motor (SM), said motor comprising a power winding (87) and a control winding (68). The control and regulating circuit for the electronically controlled motor (SM) is so designed that only one rpm above the rated rpm is controllably adjustable and, when the frequency of the clock varies, correcting signals are supplied to the AC drive pulses in power winding (87) through a bistable flip-flop (50), said flip-flop being subjected to real pulses derived from frequency dividers (6,7) and pulses derived from motor (SM), a NOR element (58) connected to the output of flip-flop (50) and an additional frequency divider (59), a field effect transistor (88), and a resistor (89). These correction signals increase the amplitude of the electrical drive signal, applied to power winding (87), and accelerate motor (SM) to the maximum set rpm. The invention can be used in time-keeping devices, especially quartz-controlled clocks, with maximally constant frequency.

5 Claims, 2 Drawing Figures

TIME-KEEPING DEVICE, ESPECIALLY A QUARTZ-CONTROLLED CLOCK

This application is a continuation, of application Ser. No. 202,385, filed as PCT DE79/00137, Nov. 15, 1979, published as WO80/01113, May 29, 1980, § 102(e) date June 19, 1980 now abandoned.

AREA OF TECHNOLOGY

The invention relates to a time-keeping device, especially a quartz-controlled clock, said clock comprising an oscillator with electronic frequency dividers, as well as an electronically controlled motor with a power winding to drive a display system and a control winding, whereby a bistable flip-flop is provided, one input of said flip-flop being controlled by the pulses of the divided quartz frequency and the other input being controlled by pulses derived from the motor, said pulses having nearly the same repetition frequency as the pulses of the divided quartz frequency, the output of said flip-flop controlling a switching element to switch the rotational speed of the display system.

STATE OF THE ART

Many electronic clocks have been proposed which use an oscillating quartz crystal as a time standard. These electronic clocks can be divided into two main groups, those with digital displays and those with analog displays.

If the time display elements in a clock with an analog time display are controlled directly by the pulses from a frequency divider, said divider subdividing the frequency of the quartz oscillator, a relatively high power consumption is required as a rule to ensure reliable advance, said power being capable of being reduced only at the price of increased sensitivity to disturbance.

Furthermore, in known systems which operate with directly controlled stepping motors, directly synchronized oscillating systems and motors, an arrangement is required which must be able to cancel out any errors within a single switching period. In such systems, sensitivity to impact can result in permanent setting errors.

In order to eliminate these disadvantages for the most part, costly special designs must be provided for the display and advance system, for example oscillating systems with a high energy content, i.e., with high amplitude and high frequency.

German Offenlegungsschrift No. 2,305,682 teaches a clock, said clock comprising a quartz oscillator with an electronic frequency divider as well as an electronically controlled motor, wherein the setting variations can be corrected relatively quickly. The display system of this clock is driven at at least two rotational speeds, whereby at least one rotational speed can be adjusted controllably higher than a set rotational speed corresponding to the quartz frequency, and at least one rotational speed can be set lower than the set rotational speed corresponding to the quartz frequency, and a memory is provided, one input of said memory being controlled by the pulses of the divided quartz frequency and the other input being controlled by pulses derived from the time-keeping system and having nearly the same repetition frequency as the pulses of the divided quartz frequency. The output of this memory controls a switching element to switch the rotational speed of the display system. This clock is characterized by the fact that the memory is a bistable flip-flop, and by the fact that the pulses derived from the motor are supplied to the bistable flip-flop through a frequency divider. Studies have shown, however, that the motor cannot be driven by this known circuit to keep accurate time when a very low load is imposed on the motor. It is true that the situation can be remedied somewhat by making the frequency divider deliver extremely fine graduations, but such fine graduations result in additional high manufacturing costs, for example, additional divider stages become necessary.

Motor drives of the type in question are also known, wherein the rotor is driven by pulses corresponding to the rotational speed of the rotor, with various widths and at various intervals. In CMOS circuitry, for example, these drive pulses have steep leading and trailing flanks. Consequently, spike pulses are induced in the control winding, said pulses being undesirable at the control input and/or interferring with the integrated circuit logic. The control input is basically provided with a trigger level which recognizes the spurious pulses, so that the logic counts more pulses than were actually applied to the control input and correspond to the rotational speed of the motor.

A capacitor is usually connected in parallel with the control winding in order to short out these spikes and/or high frequencies. Measurements have shown that this is only possible within certain limits, or can only be accomplished at the price of a considerable investment in RC elements, for example. However, this choice is an expensive one and has the disadvantage that it results in a considerable voltage drop, so that insufficient voltage is available at the control input.

Higher numbers of turns on the control winding offer only limited possibilities in this connection. They suffer from the disadvantages of volume, cost, and efficiency of the control winding.

Hence, the goal of the invention is to provide a time-keeping device, said device comprising a quartz oscillator with electronic frequency dividers as well as an electronically controlled mechanical time-keeping system with a display system, said system controlling operating errors at low manufacturing cost and with low current consumption, within a very short space of time, said system also operating in a manner which is insensitive to impact.

DESCRIPTION OF THE INVENTION

This goal is achieved by virtue of the fact that only one rotational speed above the rated rotational speed is controllably adjustable, whereby the time-keeping bistable flip-flop, after receiving the set pulse from the time standard, controls an element located between the frequency divider and an output amplifier and accelerates the motor to the maximum set rotational speed.

The advantage gained with the invention consists particularly in that only one rotational speed above the rated rotational speed is set controllably, whereby the input frequency of the frequency divider connected ahead of the synchronous motor is tapped from the divider stages of the frequency standard.

Advantageously, the regulator comprises a multistage frequency divider whose input frequency is derived from the oscillator divider, whereby the output of the divider is connected to the drive winding of the motor through a gate and an output amplifier, so that the motor rotational speed is directly dependent upon the output pulses of the frequency divider. In this manner, a time-keeping device is created which compensates for errors in operation within a very short space of time, with low manufacturing cost and with low current consumption. In a continuation of the invention, the goal is set of designing the electronic circuit in such fashion that undesirable spike pulses at the control input will not disturb the integrated control circuit logic.

This goal is achieved by virtue of the fact that a digital filter followed by a pulse shaper is provided to produce a narrow trigger pulse when switching from H to L at the control input of the motor, said filter not conducting spurious pulses having a pulse width, for example, of less than 1.95 msec, and said filter deriving the comparison and/or triggering frequency from the divider chain of the frequency standard.

This solution according to the invention ensures that spurious pulses at the input of the control circuit which fall below a certain adjustable pulse width will not be conducted, and therefore cannot interfere with the integrated control circuit logic.

In conjunction with the solution according to the invention, an acoustic signal generator can be provided, whose characterizing features consist in the fact that an electro-acoustic transducer, which can generate an acoustic signal continuously or discontinuously, and a second frequency divider chain are provided, the latter receiving the same quartz-accurate frequencies as the first frequency divider chain and is connected with the electro-acoustic transducer and an OR-gate, connected both with a first part of the first frequency divider chain and with the output of the second frequency divider chain, whereby the output of this OR-gate is connected with the input of the second part of the first frequency divider chain.

The advantage that can be gained thereby consists specifically in that the introduction of an additional divider chain powered by the standard oscillator compensates for any errors that develop in the main divider chain. In addition, the signals are generated independently of the main divider chain, thus making it possible for example to use inexpensive flip-flops for the additional chain.

Since the two divider chains and/or parts thereof are connected together by an OR-gate, it is immaterial to the function of the clock if one of these divider chains fails. If only one of these two divider chains remains intact, reliable operation of the clock is ensured.

If the two divider chains are connected by an AND-element instead of an OR-element, this circuit can serve as a monitoring device for the exact function of the divider chains, since a time pulse will only be conducted, under these conditions, if both divider chains are operating exactly identically.

However, errors can be indicated even in the circuit with the OR-gate, since it may happen that the clock time is displayed exactly while the buzzer sound is missing. In such cases, it is clear that the second divider chain is defective, while the first is still operating correctly.

In order to prevent minor relative frequency variations in the divider chain from causing the following divider stages to receive improper pulses, by responding to two pulses in rapid sequence from the two divider chains, with two counting steps, although the same time marking is involved, an adjustable filter is advantageously provided, said filter conducting a pulse only if it contains two pulses following one another in very close sequence, not exceeding a presettable interval. The unavoidable individual variations in the components used for the two divider chains are compensated in this fashion, whereby a side effect is produced, namely that the permissible individual variations can be set on this filter.

The invention permits a very wide range of designs, one of which is shown in the attached drawings.

BEST METHOD OF WORKING THE INVENTION

Figure 1:
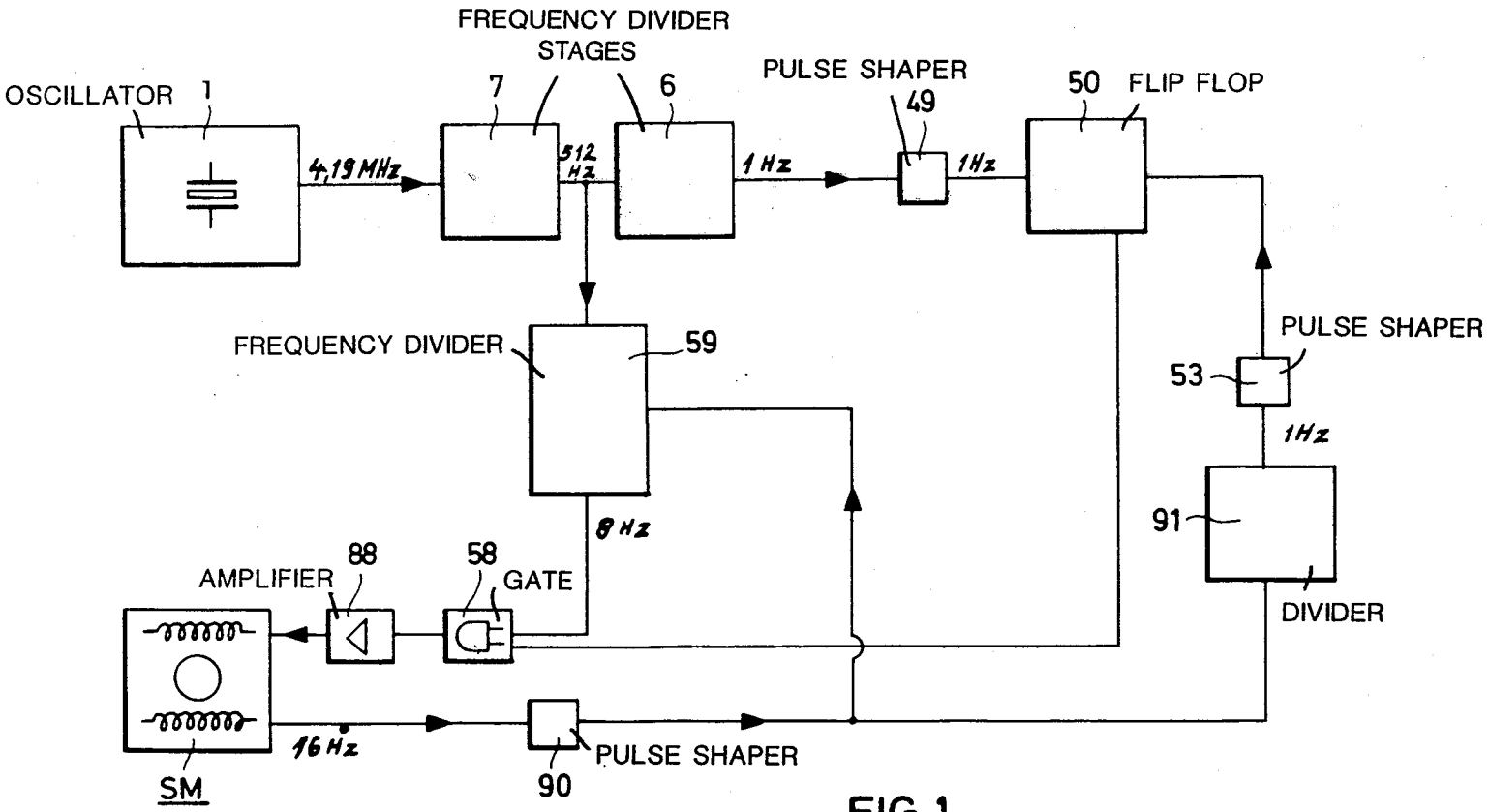
FIG. 1 is a block diagram showing the drive of a quartz clock.

The block diagram shown in FIG. 1, illustrating the drive of a quartz clock, hows an oscillator 1 which generates a frequency of 4.19 MHz followed by frequency divider stages 7 and 6, with frequency divider stage 6 generating a frequency of 1 Hz. This frequency is supplied as the set frequency to the input of a bistable flip-flop, through a pulse shaper 49.

The real frequency is generated by the control winding of synchronous motor SM, not shown in greater detail, which rotates for example at 8 rpm, and drives the hands, and, through a motor divider 91, to a second input of bistable flip-flop 50, whereby motor divider stage 91 has additional pulse shapers 90 and 53 connected ahead of and after it. The regulator consists of a multi-stage frequency divider 59, whose input frequency, 512 Hz for example, is derived from one oscillator divider 7.

The output of frequency divider 59 is connected to the drive winding of synchronous motor SM through a gate 58 and an amplifier 88, so that the motor rpm is directly dependent upon the output pulses of frequency divider 59. The time-keeping bistable flip-flop 50 switches gate 58 between frequency divider 59 and amplifier 88 after the set pulse (1 Hz) has arrived from frequency dividers 6 and 7, whereby frequency divider 59 ensures that synchronous motor SM is accelerated to the maximum set rotational speed. When the control pulse from motor divider 91 is applied to the second input of bistable flip-flop 50, i.e., when the required rotational frequency of 16 Hz for example is reached, gate 58 is blocked between frequency divider 59 and output amplifier 88. Consequently, no current can flow to synchronous motor SM and the rotational speed of the motor falls sufficiently to permit the next set pulse to switch time-keeping bistable flip-flop 50.

Figure 2:
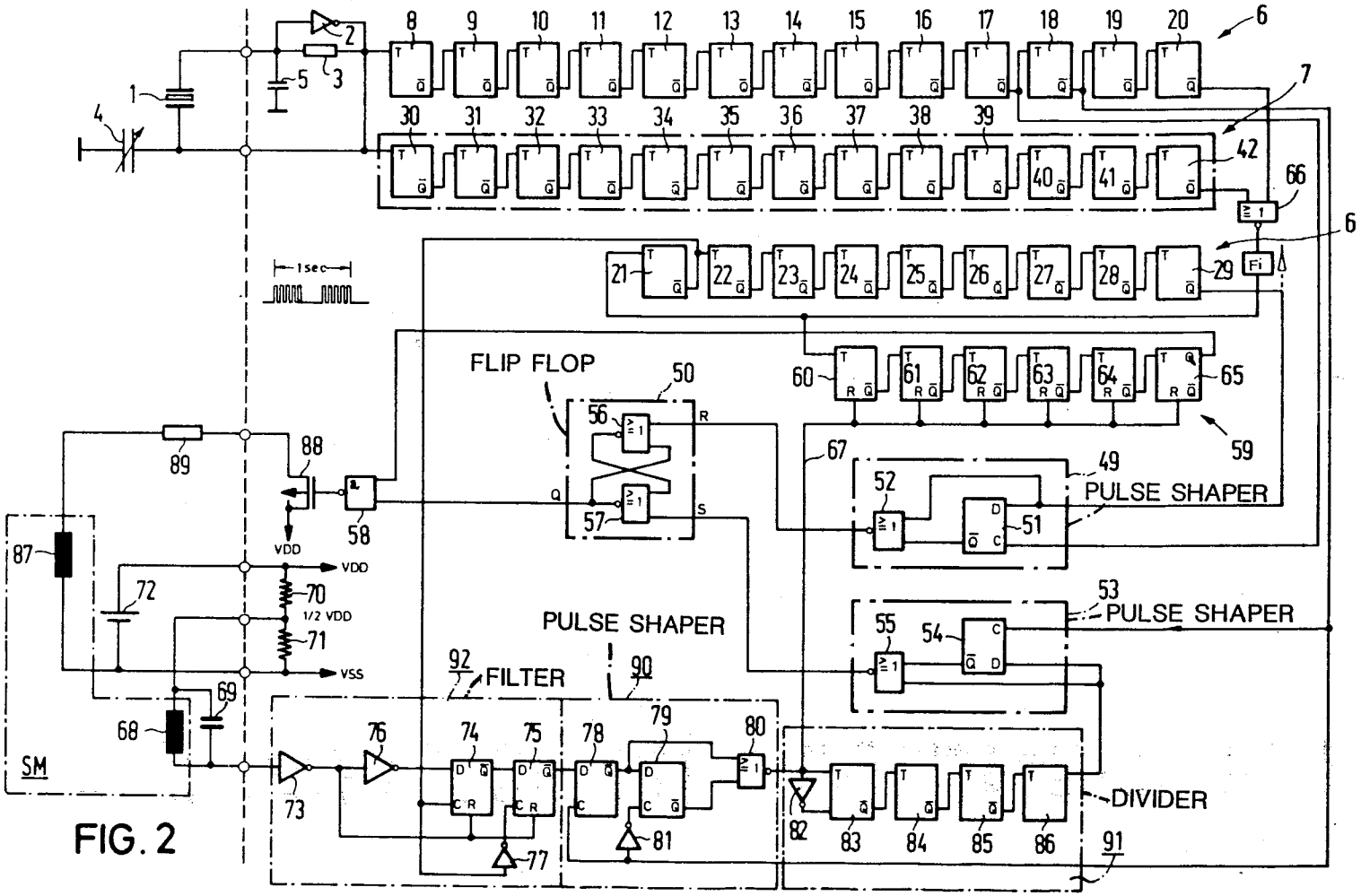
FIG. 2 is the schematic of a quartz-analog alarm clock.

The circuit shown in FIG. 2, which illustrates a quartz analog alarm clock, comprises a time reference circuit consisting essentially of an oscillator circuit and a frequency-determining quartz crystal 1. The oscillator circuit comprises an inverter 2, designed as an amplifier with infinitely high amplification, as well as a feedback resistor 3. Two capacitors 4 and 5 are connected to the leads of quartz oscillator 1 on one side and to ground on the other, said capacitors being a trimming capacitor 4, with which the manufacturer or clock maker can adjust the exact oscillation frequency, and a load capacitor 5, which has approximately the same capacitance as the trimming capacitor 4 at its middle position.

The time reference circuit generates a frequency of 4,194,304 Hz, which is subdivided in the following frequency divider chains 6 and 7.

The first frequency divider chain 6 consists of 22 flip-flops 8–29 in series, so that the 4.19 MHz signal which arrives at the input of frequency divider chain 6 is subdivided down to 1 second.

The second frequency divider chain 7, on the other hand, comprises only 13 flip-flops 30–42, i.e., the 4.19 MHz signal is subdivided only to 512 Hz.

The control and regulation of the clock will be described hereinbelow. It will be assumed that a power winding of an electric analog clock receives one or more correcting pulses, corresponding to the deviation of its time reading from a quartz time standard. In order to define these correcting pulses, the difference between the set value and the real value is formed. The set value is derived from the quartz time standard, while the rear value comes from the clock drive motor.

As outlined above, a 1 Hz signal is applied to the output of flip-flop 29 of frequency divider chain 6, said signal constituting the exact second pulses, since it comes from the quartz standard. This 1-second pulse sequence, or second set value, is supplied to an RS flip-flop 50 through a pulse shaper 49, said flip-flop 50 producing pulse-modulated signals at its output. The second pulses, coming from frequency divider flip-flop 29, emerge at one input of the D flip-flop 51 in pulse shaper 49, while a 4096 pulse train reaches the other input of this flip-flop 51, said pulse train being branched off from divider chain 6.

NOR gate 52 receives both the second pulses and the pulses from the Q output of the flip-flop. The x pulses with a pulse interval of 1 second and a pulse width of 4096 Hz $\geqq 2.441.10^{-4}$ seconds appear at the output of NOR gate 52. These pulses represent the set frequency of the clock.

The real frequency is now prepared in the same manner as the set frequency. A separate pulse shaper 53 is provided for this purpose, said shaper consisting of a D flip-flop 54 and a NOR gate 55. To this pulse shaper 53 is supplied the 1 Hz real signal of the clock motor and a 2048 Hz signal from frequency divider chain 6.

Thus, a 1 second real pulse train appears at the output of NOR gate 55, with a pulse width of 1/2048 Hz$=4.88.10^{-4}$ seconds.

RS flip-flop 50, composed of the two cross-coupled NOR gates 56 and 57, thus receives set pulses from NOR gate 52, while it receives real pulses from NOR gate 55. The pulse intervals in both cases are 1 second, whereby the pulse widths of the two pulse trains differ by a factor of 2, so that the real value remains dominant.

An L signal then appears at output Q of RS flip-flop 50, when an L signal appears at input R and an O signal appears at input S. On the other hand, if combination S=L/R=O appears, Q=O. With S=L/R=L, an irregular interval will develop. However, since the pulse widths of the set and real pulses are different, the irregular state will not occur. The pulses appearing at the output of RS flip-flop 50 therefore have a pulse width which corresponds to the difference in time between 1 set second pulse and 1 real second pulse. The time difference is thus displayed in a pulse width modulated form.

The pulse width modulated time differential then corrects the amplitudes of the sine-wave signals which the drive winding of the clock receives. However, these signals are not applied without prior modification by a NAND gate 58, which is supplied at its second input with signals from a frequency divider chain 59, said chain consisting of six flip-flops 60–65.

This frequency divider chain 59 has its input connected to the 512 Hz frequency, supplied to it via an OR gate 66, either from frequency divider chain 6 or from frequency divider chain 7. As we have already mentioned, the output of frequency divider chain 59 is connected to NAND gate 58. Frequency divider chain 59 can subdivide the frequency of 512 Hz to 8 Hz with the aid of six flip-flops 60–65. One special feature of frequency divider chain 59 is that it can be set by a line 67, so that it constitutes a binary number. Since flip-flops 60–65 have setting inputs R, S, R, S, R, and R, this means that binary number 1010 can be displayed with flip-flops 63, 62, 61, and 60, corresponding to decimal number 10. In order to set this number, a pulse on line 67 is sufficient. By subsequent pulsing of frequency divider chain 59 from divider chains 6 and 7, the set binary number can be counted down. The function of the frequency divider chain is described in greater detail hereinbelow. However, it is necessary first to describe how the real pulses are derived in detail.

The starting element for receipt of the real time is control winding 68 of the clockwork, driven by a continuously rotating motor in such fashion that it generates a voltage which is a measure of the rotational speed of the motor. The voltage induced in control winding 68 is then processed further and prepared.

A capacitor 69 is connected in parallel with control winding 68, the purpose of said capacitor being to short out any spurious voltage spikes.

A center tap of a voltage divider, comprising resistors 70 and 71, is connected in series with the parallel circuit composed of control winding 68 and capacitor 69, whereby the voltage divider is in turn connected to a battery 72. This ensures that the AC voltage potential that appears on control winding 68 will be increased by a DC component so that inverter 73, which is simultaneously an input threshold value switch, conducts at the correct points during the AC voltage real signal, thus producing a square wave signal which corresponds exactly to the AC voltage real signal.

A connection runs from the output of inverter 73 to the R inputs of two flip-flops 74 and 75 as well as to the input of an inverter 76, whose output is connected to the D input of flip-flop 74. The C inputs of flip-flops 74 and 75 are connected by another inverter 77 with the output of flip-flop 21 of divider chain 6. Digital filter 92 consists of the totality of elements 74, 75, 76, and 77, said filter filtering out frequencies above 256 Hz. Instead of 256 Hz, the filter frequency could also be another frequency, the only important thing being that the 16 Hz frequency normally present on the control winding 68 is passed.

After the digitized and digitally filtered real signal has passed through digital filter 92, it reaches a pulse shaper 90, which produces a quasi spike-pulse train from the relatively broad 16 Hz signal. This spike-pulse shaper 90 consists of two flip-flops 78 and 79 of a NOR gate 80 and an inverter 81, whereby inverter 81 is supplied with a 2048 Hz signal from frequency divider chain 6.

Thus, 16 Hz pulses appear at the output of NOR gate 80, said pulses having a width at the base of 1/2048 Hz$=4.882.10^{-4}$ seconds. These 16 Hz spikes control another inverter 82 and a counter chain 91 with four flip-flops 83, 84, 85, and 86, which supplies a 1 Hz real signal at the output. This real signal, as mentioned above, is supplied to pulse shaper 53.

Now we shall consider once again the output signal from gate 80, which is supplied to divider chain 59 via line 67. This signal is processed so that it is applied precisely as a sine-wave signal in control winding 68 passes through zero.

During this passage through zero, therefore, flip-flops 60–65 are set to a binary number, for example a binary number corresponding to decimal number 10. Now the input of chain 59 receives 512 Hz pulses until the chain has a decimal counter status 32, i.e., until a H signal appears at the output of chain 59. This ensures that chain 59 acts, so to speak, as a timer, which determines the point in time at which the electric signal supplied to the drive motor is given a correcting pulse. Therefore, the correcting signal is given at gate 58 after an exactly predetermined space of time following the starting point has been clearly defined by the signal coming from gate 80.

Thus, correction signals are supplied to the AC drive pulses of power winding 87 through a field-effect transistor 88 and a resistor 89. These correction signals increase the amplitude of the electrical drive signal, applied to power winding 87, by an amount which corresponds to the frequency deviation of the clock. The increase in amplitude can therefore vary from half-wave to halfwave of the AC signal on power winding 87, whereby the variation depends upon the average deviation between the set value and the real value.

The only purpose of resistance 89 is to dampen the correcting pulses supplied to power winding 87, as a function of the required drive energy. If, for example, relatively heavy hands are driven by the clock motor, resistor 76 can be made very small so that power winding 87 receives a great deal of energy.

The function of the digital filter according to the invention, mentioned at the outset, with a following pulse shaper, will now be described separately below:

The low-pass consists of the two D flip-flops 74 and 75 and the two inverters 73 and 76. A sine-wave control voltage of approximately 16 Hz from the motor is supplied at the input. Inverter 73 digitizes this control voltage to a square-wave voltage. If the input is H, the output of the second inverter 76 is likewise H. If the comparison signal at the clock input of D flip-flop 74 switches to H, output Q/74 also becomes H. L is applied to the clock input of D flip-flop 75 until C/75 becomes H, corresponding to 256 Hz $\frac{1}{2}$ T=1.95 msec. When C/75 becomes H and D/75 is still H, the output of filter Q/75 becomes H. The input signal is then conducted, since it is <256 Hz.

If we assume that a spurious pulse appears at the input, in other words the pulse has a pulse width less than 1.98 msec, D/74 becomes H.

The comparison frequency, e.g. 256 Hz, switches with its positive slope at C/74 Q from 74 to H. 75, however, does not yet conduct, since inverter 77 applies L to C/75.

If the spurious pulse is shorter than 1.95 msec at the input, the output of 73 becomes H.

74 and 75 are reset before the signal can be conducted from C/75 to D/75.

The pulse-shaper stage which follows now ensures that with a change from H to L at the input, a spike pulse is produced at the output of the pulse-shaper stage which is independent of the pulse width of the input signal and has for example, a pulse width of approximately 0.25 msec. The comparison frequency required for pulse shaping, therefore, is taken from the frequency divider of the time-keeping divided chain.

Commercial Application

The invention can be used for time-keeping devices, especially quartz-controlled clocks, with highly constant frequency.

We claim:

1. A quartz controlled timing device including a display system comprising:

an oscillator;

first and second electronic frequency divider stages, coupled to said oscillator for delivering a first pulse train having a first frequency;

an electronically controlled motor, with a set rotational speed, having an operating winding which drives the display system and a pick-up winding detecting the rotations of the motor and delivering a second pulse train having a second frequency;

means for converting said second pulse train into a third pulse train having approximately the same frequency as said first pulse train;

a flip-flop means having a first and second input and an output, said first input receiving said first pulse train from said electronic frequency divider stages, said second input receiving said second pulse train, said output providing a high level signal after a set pulse of the first pulse train has arrived from said frequency divider stages and a low level signal after a pulse of the third pulse train has arrived from said converting means;

a multi-stage frequency divider having two inputs and an output, said first input being connected with the output of the first electronic frequency divider stage for providing a third frequency, said second input receiving the second pulse train;

a gate means for providing a fourth pulse train having a fourth frequency and having a first and second input and an output, said output of said multi-stage frequency divider being connected to said first input of said gate means, said second input of which being connected to said output of said flip-flop means; and an amplifier means responsive to the output pulses of said gate means for applying said fourth pulses from the output of said multi-stage frequency divider to the operating winding of said electronically controlled motor when the output of said flip-flop means is generating a high level output signal, thus accelerating said motor to a maximum of set rotational speed and for dropping a flow of current to said motor when the output of said flip-flop means is generating a low level output signal thus being only one rotational speed above the set rotational speed controllably adjustable.

2. The timing device as in claim 1 wherein said means for converting said second pulse train into a third pulse train includes a digital filter means electrically connected to said pick-up winding of said motor and a pulse shaper means electrically connected to said digital filter means at an input.

3. The timing device as in claim 1 wherein said digital filter means includes a first inverter for converting said second pulse train into a square wave signal and electrically coupled to said pick-up winding of said motor and acting as a threshold switch having a trigger frequency tapped from said electronic frequency dividers, said pulse shaping means generating narrow trigger pulses from the falling edges of said square wave signal whereby noise pulses of adjustable pulse width are substantially blocked.

4. The quartz controlled timing device as in claim 2 where said digital filter means includes a low-pass filter including first and second flip-flops and said first inverter and a second inverter.

5. The quartz controlled timing device as in claim 3 wherein said pulse shaper includes a monostable multivibrator electrically connected in series after said low-pass filter.

* * * * *